US006837314B2

(12) United States Patent
Krueger et al.

(10) Patent No.: US 6,837,314 B2
(45) Date of Patent: Jan. 4, 2005

(54) SUB APPARATUS WITH EXCHANGEABLE MODULES AND ASSOCIATED METHOD

(75) Inventors: Volker Krueger, Celle (DE); Wolfgang Herberg, Bergen (DE); Gunnar Bothmann, Celle (DE); Matthias Meister, Celle (DE); Sven Krueger, Celle (DE)

(73) Assignee: Baker Hughes Incoporated, Houston, TX (US)

( * ) Notice: Subject to any disclaimer, the term of this patent is extended or adjusted under 35 U.S.C. 154(b) by 0 days.

(21) Appl. No.: 10/100,670

(22) Filed: Mar. 18, 2002

(65) Prior Publication Data

US 2003/0173115 A1 Sep. 18, 2003

(51) Int. Cl.[7] ..... E21B 49/10; E21B 47/024; E21B 47/06

(52) U.S. Cl. ..... 175/59; 175/45; 175/50; 166/264; 166/254.2; 73/152.24

(58) Field of Search ..... 175/45, 50, 58, 175/59, 61, 82; 166/241.5, 264, 255.1, 254.2; 73/152.03, 152.19, 152.24, 152.26, 152.55

(56) References Cited

U.S. PATENT DOCUMENTS

| | | | | | |
|---|---|---|---|---|---|
| 3,611,799 | A | * | 10/1971 | Davis | 73/152.24 |
| 4,416,152 | A | * | 11/1983 | Wilson | 73/152.26 |
| 4,435,978 | A | * | 3/1984 | Glatz | 73/152.31 |
| 4,747,304 | A | | 5/1988 | King | 73/155 |
| 4,860,580 | A | * | 8/1989 | DuRocher | 73/152.26 |
| 4,860,581 | A | * | 8/1989 | Zimmerman et al. | 73/152.26 |
| 4,936,139 | A | * | 6/1990 | Zimmerman et al. | 73/152.26 |
| 4,950,844 | A | * | 8/1990 | Hallmark et al. | 175/59 |
| 5,353,637 | A | * | 10/1994 | Plumb et al. | 73/152.17 |
| 5,358,057 | A | * | 10/1994 | Peters et al. | 175/20 |
| 5,741,962 | A | * | 4/1998 | Birchak et al. | 73/152.16 |
| 5,803,186 | A | * | 9/1998 | Berger et al. | 175/50 |
| 6,023,443 | A | * | 2/2000 | Dubinsky et al. | 367/76 |
| 6,088,294 | A | * | 7/2000 | Leggett et al. | 367/25 |
| 6,155,608 | A | | 12/2000 | Skinner et al. | 285/125.1 |
| 6,157,893 | A | | 12/2000 | Berger et al. | 702/9 |
| 6,164,126 | A | * | 12/2000 | Ciglenec et al. | 73/152.01 |
| 6,179,066 | B1 | * | 1/2001 | Nasr et al. | 175/45 |
| 6,206,108 | B1 | * | 3/2001 | MacDonald et al. | 175/24 |
| 6,223,822 | B1 | * | 5/2001 | Jones | 166/250.05 |
| 6,427,530 | B1 | * | 8/2002 | Krueger et al. | 73/152.46 |
| 6,427,783 | B2 | * | 8/2002 | Krueger et al. | 175/40 |
| 6,439,046 | B1 | * | 8/2002 | Kruspe et al. | 73/152.01 |
| 6,478,096 | B1 | * | 11/2002 | Jones et al. | 175/50 |

FOREIGN PATENT DOCUMENTS

| | | |
|---|---|---|
| EP | 0362010 A2 | 4/1990 |
| EP | 0978630 A2 | 9/2000 |
| GB | 2334981 | 9/1999 |
| GB | 2377952 A | 1/2003 |

* cited by examiner

*Primary Examiner*—David Bagnell
*Assistant Examiner*—Shane Bomar
(74) *Attorney, Agent, or Firm*—Madan, Mossman & Sriram, P.C.

(57) ABSTRACT

The present invention is an apparatus and method for use in a well borehole drilled into a formation. The apparatus comprises a work string disposed in the borehole. The work string includes at least one modular body portion having at least one receptacle. A modular tool is disposed in the at least one receptacle for carrying out a drilling operation. The modular tool may be a tool for use in drilling a well borehole, it may be a tool for testing a formation surrounding a borehole, or the modular tool may be a combination. For example, one aspect of the present invention provides a modular steering rib. The modular steering rib may also include modular components for sampling and testing formation fluid.

25 Claims, 5 Drawing Sheets

SUB APPARATUS WITH EXCHANGEABLE MODULES AND ASSOCIATED METHOD

BACKGROUND OF THE INVENTION

1. Field of the Invention

This invention relates generally to apparatus and methods for evaluating formations traversed by a well borehole, and more particularly to a testing apparatus having modular testing components and methods for using a modular testing device in formation evaluation operations.

2. Description of the Related Art

In the oil and gas industry, formation testing tools have been used for monitoring formation pressures along a well borehole, obtaining formation fluid samples from the borehole and predicting performance of reservoirs around the borehole. Such formation testing tools typically contain an elongated body having an elastomeric packer that is sealingly urged against a zone of interest in the borehole to collect formation fluid samples in fluid receiving chambers placed in the tool.

Downhole multi-tester instruments have been developed with extensible sampling probes for engaging the borehole wall at the formation of interest for withdrawing fluid samples therefrom and measuring pressure. In downhole instruments of this nature it is typical to provide an internal piston, which is reciprocated hydraulically or electrically to increase the internal volume of a fluid receiving chamber within the instrument after engaging the borehole wall. This action reduces the pressure at the instrument formation interface causing fluid to flow from the formation into the fluid receiving chamber of the instrument.

During drilling of a borehole, a drilling fluid "mud" is used to facilitate the drilling process and to maintain a pressure in the borehole greater than the fluid pressure in the formations surrounding the borehole. This is particularly important when drilling into formations where the pressure is abnormally high: if the fluid pressure in the borehole drops below the formation pressure, there is a risk of blowout of the well. As a result of the pressure difference induced by the drilling fluid, the drilling fluid penetrates into or invades the formations for varying radial depths (referred to generally as invaded zones) depending upon the types of formation and drilling fluid used. The formation testing tools retrieve formation fluids from the desired formations or zones of interest, test the retrieved fluids to ensure that the retrieved fluid is substantially free of mud filtrates, and collect such fluids in one or more chambers associated with the tool. The collected fluids are brought to the surface and analyzed to determine properties of such fluids and to determine the condition of the zones or formations from where such fluids have been collected.

One feature that all such testers have in common is a fluid sampling probe. This may consist of a durable rubber pad that is mechanically pressed against the formation adjacent the borehole, the pad being pressed hard enough to form a hydraulic seal. The pad has an opening, which is typically supported by an inner metal tube often referred to as a ("probe"). The probe is used to make contact with the formation, and is connected to a sample chamber that, in turn, is connected to a pump that operates to lower the pressure at the attached probe. When the pressure in the probe is lowered below the pressure of the formation fluids, the formation fluids are drawn through the probe into the well bore to flush the invaded fluids prior to sampling. In some prior art devices, a fluid identification sensor determines when the fluid from the probe consists substantially of formation fluids; then a system of valves, tubes, sample chambers, and pumps makes it possible to recover one or more fluid samples that can be retrieved and analyzed when the sampling device is recovered from the borehole.

SUMMARY OF THE INVENTION

The present invention provides a modular drilling tool and method to address some of the drawbacks existing in conventional tools used for drilling and other downhole well operations.

One aspect of the present invention is an apparatus for use in a well borehole drilled into a formation. The apparatus comprises a work string disposed in the borehole. The work string includes at least one modular body portion having at least one receptacle. A modular tool is disposed in the at least one receptacle for carrying out a drilling operation.

The modular tool may be a tool for use in drilling a well borehole, it may be a tool for testing a formation surrounding a borehole, or the modular tool may be a combination of formation testing and drilling control tools. For example, one aspect of the present invention provides a modular steering rib that includes modular components for sampling and testing formation fluid.

Another aspect of the present invention is a method of conducting drilling operations. The method comprises coupling one or more modular tools to receptacles in a work string and conveying the work string into a well borehole. The work string is then used to conduct the drilling operations.

In another aspect, the present invention provides a system comprising a work string conveyed in a well borehole. A sub is coupled to the work string, and the sub includes at least one receptacle. A modular tool is detachably coupled to the sub in the at least one receptacle for conducting the drilling operation, and a controller is disposed at the surface for controlling the drilling tool.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE INVENTION

Figure 1:
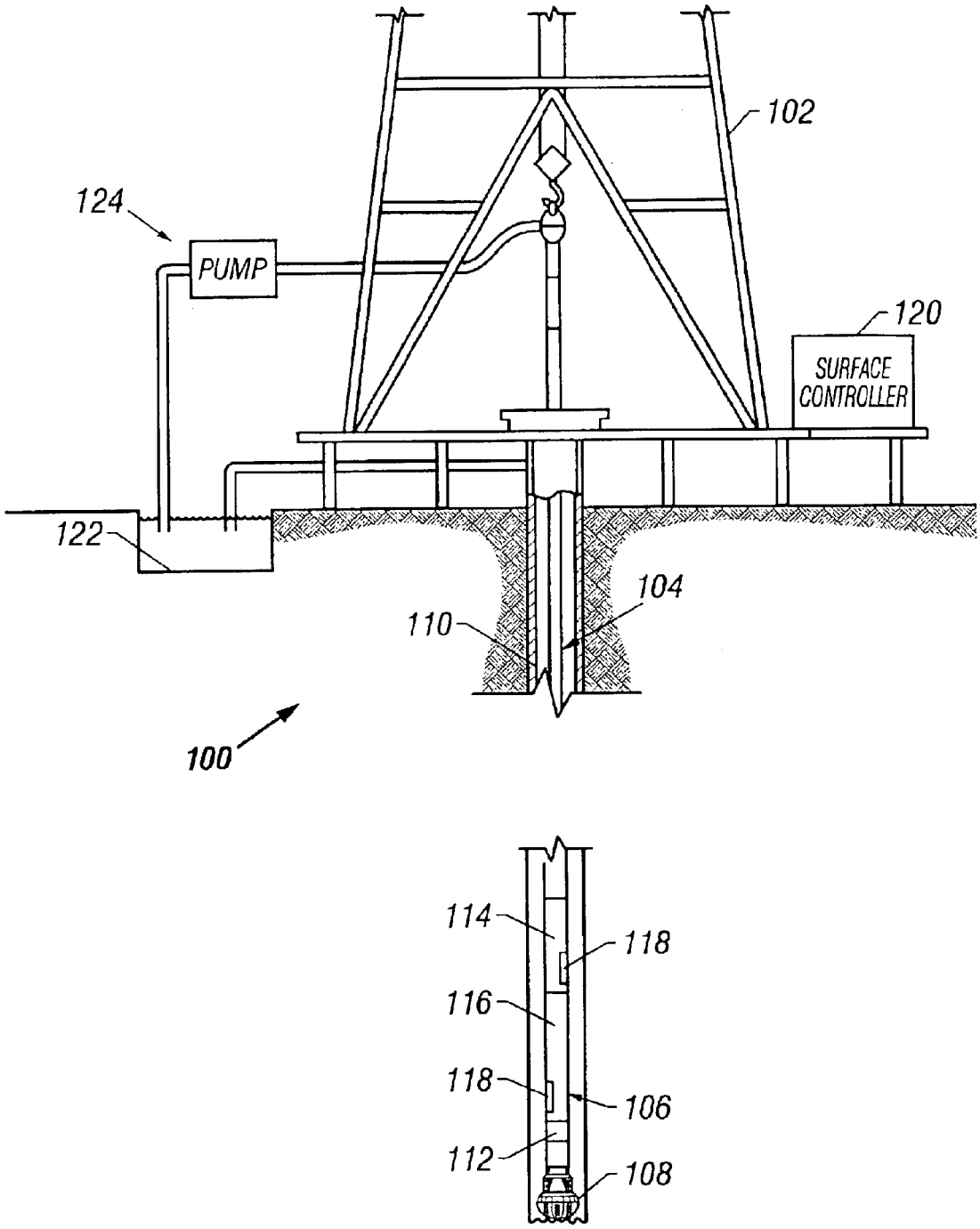
FIG. 1 is an elevation view of a drilling system including a modular sub according to one embodiment of the present invention.

FIG. 1 is an elevation view of a drilling system 100 in a measurement-while-drilling (MWD) arrangement according to the present invention. A conventional derrick 102 supports a drill string 104, which can be a coiled tube or drill pipe. The drill string 104 carries a bottom hole assembly (BHA) 106 and a drill bit 108 at its distal end for drilling a borehole 110 through earth formations.

Drilling operations include pumping drilling fluid or "mud" from a mud pit 122, and using a circulation system 124, circulating the mud through an inner bore of the drill string 104. The mud exits the drill string 104 at the drill bit 108 and returns to the surface through the annular space between the drill string 104 and inner wall of the borehole 110. The drilling fluid is designed to provide the hydrostatic pressure that is greater than the formation pressure to avoid blowouts. The pressurized drilling fluid also drives a drilling motor and provides lubrication to various elements of the drill string.

Modular subs 114 and 116 according to the present invention are positioned as desired along the drill string 104. As shown, the modular sub 116 may be included as part of the BHA 106. Each modular sub includes one or more modular components 118. The modular components 118 are preferably adapted to provide formation tests while drilling ("FTWD") and/or functions relating to drilling parameters. It is desirable for drilling operations to include modular components 118 adapted to obtain parameters of interest relating to the formation, the formation fluid, the drilling fluid, the drilling operations or any desired combination. Characteristics measured to obtain the desired parameter of interest may include pressure, flow rate, resistivity, dielectric, temperature, optical properties, tool azimuth, tool inclination, drill bit rotation, weight on bit, etc. These characteristics are processed by a processor (not shown) downhole to determine the desired parameter. Signals indicative of the parameter are then telemetered uphole to the surface via a modular transmitter 112 located in the BHA 106 or other preferred location on the drill string 104. These signals may be stored downhole in an appropriate data storage device and may also be processed and used downhole for geosteering.

Figure 2:
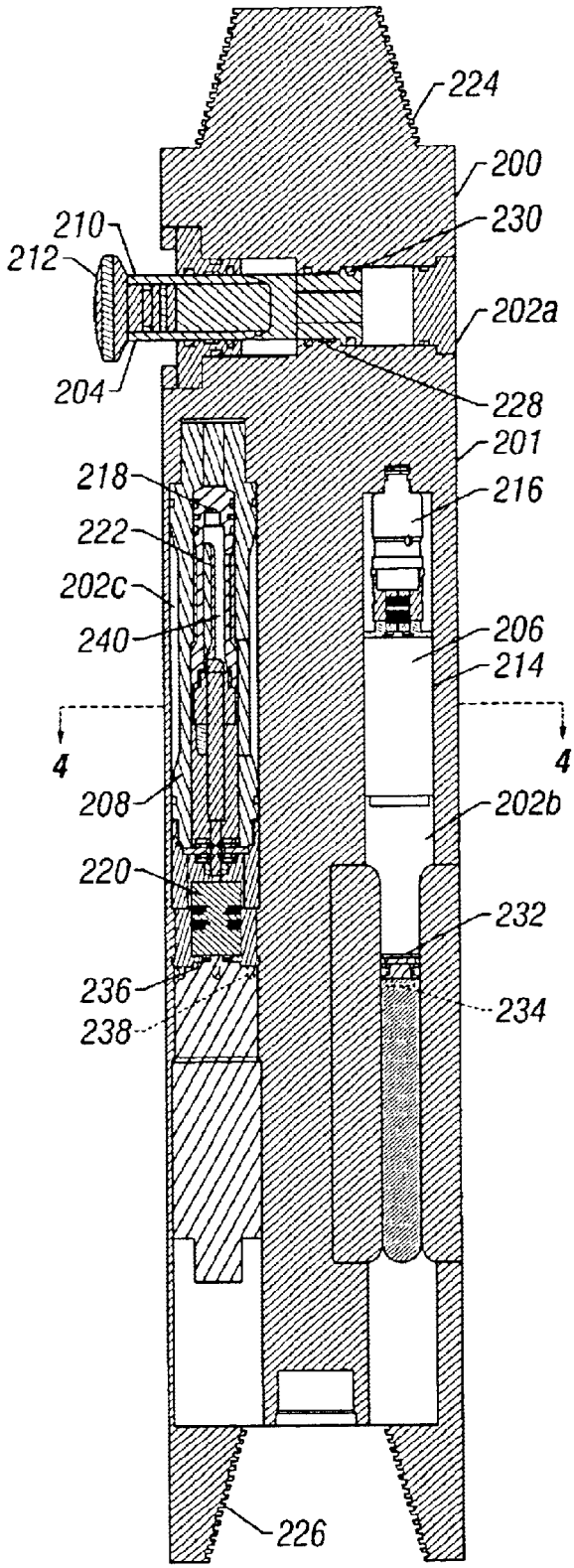
FIG. 2 shows a modular MWD sub according to the present invention adapted for use in the drilling system of FIG. 1.

FIG. 2 shows a modular MWD sub according to the present invention adapted for use in the drilling system of FIG. 1. The modular MWD sub, or simply sub 200 includes a sub body 201 and one or more receptacles 202*a–c* formed in the sub body 201. The term "receptacle" as used herein is defined as any recess, opening or groove formed in a structure for receiving a device. Each receptacle 202*a–c* is adapted to receive a modular tool component. The term modular tool component as used herein is defined as a device adapted for connection and disconnection with respect to a receptacle. FIG. 2 shows a probe module 204 coupled to the sub 200 in a probe receptacle 202*a*. A pump module 206 is coupled to the sub 200 in a pump receptacle 202*b*, and a test module 208 is shown coupled to the sub 200 in a test module receptacle 202*c*. Each module shown performs a desired function for MWD testing and/or drilling control.

The sub 200 is constructed using known materials and techniques for adapting the sub 200 to a drill string such as the drill string 104 shown in FIG. 1 and described above. The sub 200 shown includes threaded couplings 224 and 226 for coupling the sub 200 to the drill string 104. The sub body 201 is preferably steel or other suitable metal for use in a downhole environment.

The probe module 204 includes an extendable probe 210 and a sealing pad 212 coupled to one end of the extendable probe 210. The probe module has a connector 228 that enables quick connection and detachment of the probe module 204 into the corresponding probe module receptacle 202*a*. The sub body 201 includes a connector 230 compatible with the probe connector 228. The connectors 228 and 230 may be any suitable connectors that allow quick insertion and detachment of the probe module 204 inside the sub body 201. The connectors may be threaded connectors, plug-type connectors, or other suitable connector.

The probe module is operationally coupled to the pump module 206. Coupling the probe module 204 to the pump module 206 is accomplished when the modules 204 and 206 are installed in their respective receptacles 202*a* and 202*b*. The coupling mechanism depends upon the operating principles of the components. In one embodiment, the extendable probe module 204 is hydraulically operated and is coupled to the pump module 206 by fluid lines (not shown) pre-routed through the sub body 201. In another embodiment, the extendable probe module 204 is electrically operated and is coupled to the pump module 206 by electrical conductors (not shown) pre-routed through the sub body 201 those skilled in the art having the benefit of the above embodiments would also understand an alternative embodiment wherein the probe module 204 utilizes a combined electrical/hydraulic arrangement for operation. As such, the connectors 228 and 230 would include both electrical and hydraulic connections. This arrangement does not require further illustration.

The sealing pad 212 is attached to a distal end of the extendable probe 210 using any suitable attaching device or adhesive. The sealing pad 212 is preferably a strong polymer material to provide for sealing a portion of the borehole wall when the extendable probe 210 is extended, while resisting wear-out caused by down-hole abrasive conditions. Any well-known sealing pad material may be used for constructing the sealing pad 212.

In the embodiment shown in FIG. 2, the pump module 206 is coupled to the probe module 204 as described above. The pump module 206 operates to extend and retract the extendable probe 210 and to extract or draw formation fluid from an adjacent formation (not shown). The pump module shown includes a motor 214 coupled to a pump 216. The motor 214 and pump 216 may be any suitable known motor and pump adapted according to the present invention for modular interface with the sub 200. Connectors 232 and 234 are used to detachably mount the pump module 206 into the pump module receptacle 202*b*. The connectors 232 and 234 are any suitable connectors that will provide mechanical, hydraulic and/or electrical detachable coupling for the pump module 206. The particular pump module selected will determine the connector required. For example, the pump module may comprise a ball-screw pump driven by an electrical motor. The connectors 232 and 234 need not be functionally or mechanically identical to one another. For example, one connector 232 may be an electrical plug-type connector (as shown) for connecting power to the pump module, while the other connector 234 (as shown) may be a fluid quick-disconnect connector for coupling the pump 216 to fluid lines (not shown) leading to the probe module 204.

Continuing with the embodiment of FIG. 2, the test module 208 is detachably coupled to the sub body 201 in the test module receptacle 202*c* using suitable connectors 236 and 238. The connectors 236 and 238 are any suitable connectors that will provide mechanical, hydraulic and/or electrical detachable coupling for the test module 206. The particular test module selected will determine the connector required as described above with respect to the pump module and associated connectors. Likewise, the connectors 236 and 238 need not be functionally or mechanically identical to one another. For example, one connector 236 may be an electrical plug-type connector (as shown) for connecting power to the test module 208, while the other connector 238 (as shown) may be a fluid quick-disconnect connector for coupling the test module 208 to fluid lines (not shown) leading to the probe module 204.

The test module 208 shown includes a motor 220 and a fluid sampling device 222. The sampling device 222 is preferably a reciprocating piston operated by the motor 220. Alternatively, the fluid sampling device 222 may be a motor driven pump, wherein the motor may be an electric or a mud-driven motor. Alternatively, the sampling device may be a hydraulic piston operated by a proportional valve. Upon activating the sampling device, a pressure differential is created and the differential is used to urge fluid into the device. The test module 208 is operatively associated with the probe module 204 for determining one or more parameters of interest of the formation fluid received through the probe. These parameters of interest may be any combination of fluid pressure, temperature, resistivity, capacitance, mobility, compressibility and fluid composition. The test module includes an appropriate sensor or sensors 218 for measuring characteristics indicative of the parameters of interest. For example, the test module may include any number of known pressure sensors, resistivity sensors, thermal sensors, sonic sensors, gamma sensors, nuclear magnetic resonance (NMR) sensors, and or any sensor arrangement useful in drilling or formation evaluation operations. Alternatively, the sensors may be disposed within the probe module with the sensor output being transferred to the test module via electrical conductors (not shown) pre-routed within the sub.

In operation, formation fluid entering the probe module 204 is independently drawn into a chamber 240 located in the test module using the fluid sampling device 222. A sensor 218 as described above is coupled to the chamber for sensing a characteristic of the formation fluid drawn into the chamber. A downhole processor (not shown) is adapted to accept an output of the sensor 218 and to determine the desired parameter of interest associated with the measured characteristic.

Figure 3:
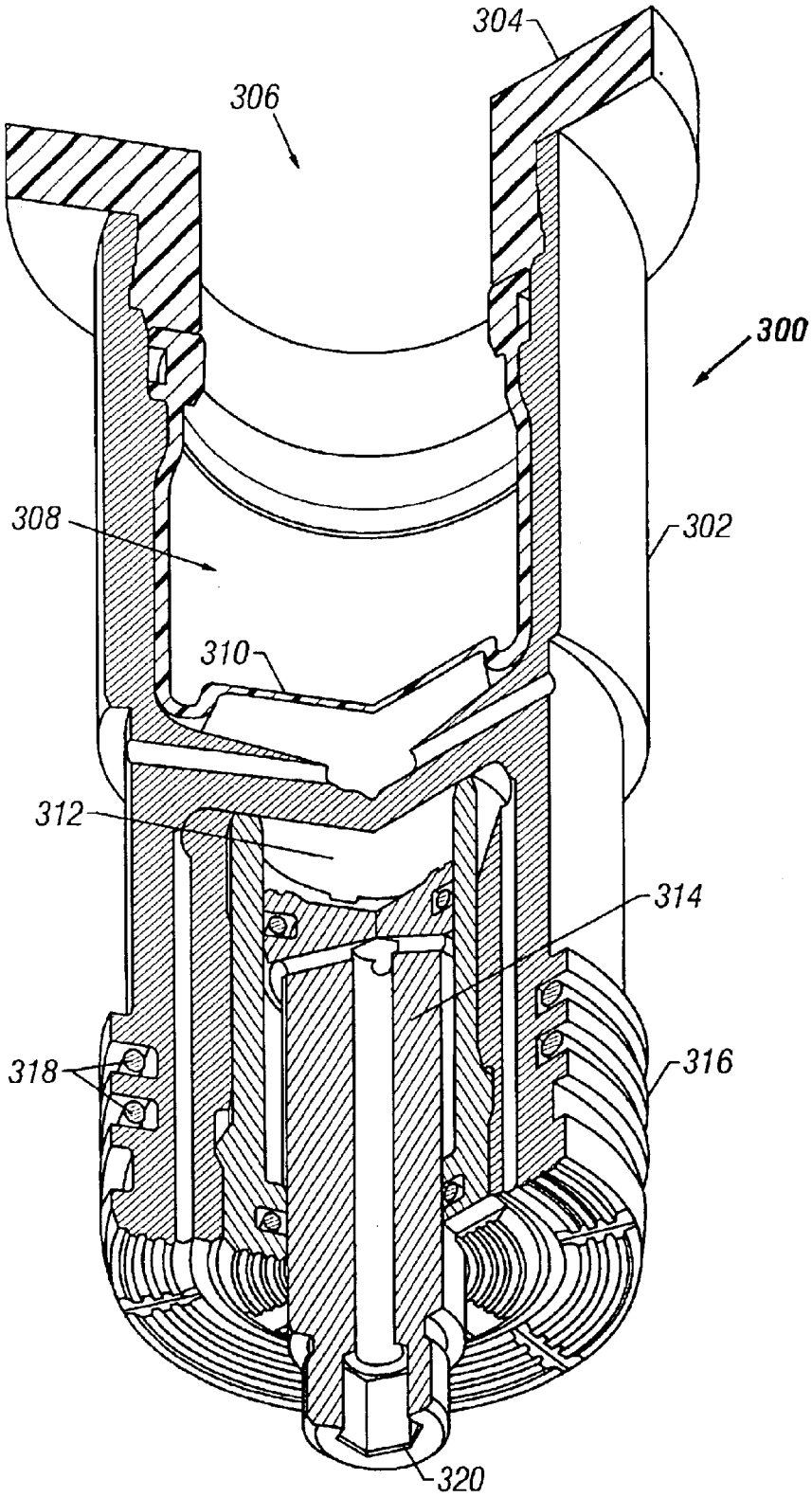
FIG. 3 is a cross section of an extendable probe module according to the present invention.

A particularly useful modular probe for use in a probe module according to the present invention is shown in FIG. 3. FIG. 3 is a cross section view of an extendable probe module 300 substantially as described above and shown as probe module 204 without a pad member. In FIG. 3, the probe module 300 includes an extendable probe body 302 having a sealing pad holder 304 disposed on an end thereof. A sealing pad as the sealing pad 212 of FIG. 2 would in operation be attached to the sealing pad holder 304 using any suitable known attaching method. The sealing pad holder 304 retains the sealing pad 212 and the combination is used to provide sealing engagement with a borehole wall when the probe body 302 is extended. A sample chamber 308 located in the probe body 302 includes a flexible diaphragm 310 to separate the sample chamber 308 from a hydraulic oil chamber 312. The hydraulic oil chamber 312 and the sample chamber 308 remain in pressure communication via the flexible diaphragm 310. In operation, formation fluid is received in the sample chamber via an opening 306.

The hydraulic oil chamber 312 is filled with oil or other suitable hydraulic fluid. A piston 314 is operatively associated with the pump module 206 described above and shown in FIG. 2. Axial movement of the piston 314 changes the volume of the hydraulic oil chamber 312. Axial movement away from the flexible diaphragm 310 reduces pressure in the hydraulic oil chamber 312 and the diaphragm flexes to increase the volume of the sample chamber 308 thereby increasing the volume of the sample chamber 308. Increasing the volume of the sample chamber 308 reduces pressure in chamber 308 and urges formation fluid into the sample chamber 308 for testing.

When sampling and/or testing are complete, the piston 314 is operated in the opposing axial direction to purge the sample chamber 308 of formation fluid. This action also helps in retracting the probe 302 by increasing pressure in the sample chamber 308.

The modular probe 300 shown couples to the sub 200 in the probe receptacle 202*a*. A suitable probe coupling 316 is shown that allows detachable coupling to the sub 200 and provides a good seal. Standard O-ring seals 318 provide pressure sealing when the probe 300 is connected to the sub 200. An appropriate fitting 320 is integral to the piston 314 to allow automatic connection when the probe 300 is inserted into the probe receptacle 202*a*.

Figure 4:
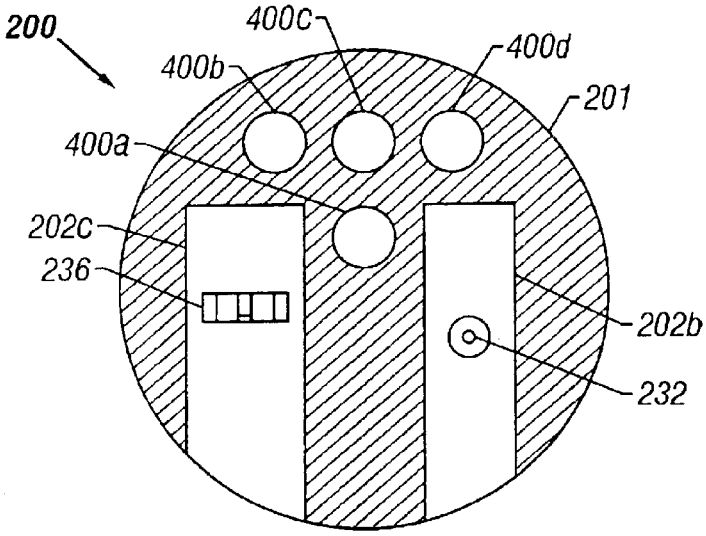
FIG. 4 is a cross section of a drill pipe adapted to receive a fixed modular component.

FIG. 4 is a cross section of the sub in FIG. 2 to show how drilling fluid is circulated through a modular sub 200 according to one embodiment of the present invention. Shown in FIG. 4 is the sub body 201 including the pump module receptacle 202*b* and the test module receptacle 202*c*. The pump module 206 and the test module 208 described above and shown in FIG. 2 are removed for clarity. The pump module receptacle 202*b* is shown with the plug-type connector 232 as in FIG. 2 for coupling the pump module 206 to the sub body 201. The test module receptacle 202*c* is shown with the plug-type connector 236 of FIG. 2 for coupling the test module 208 to the sub body 201. Each module may be fitted with additional couplings such as fasteners as desired to ensure the associated modular component remains fixed within the sub body during operations.

During drilling, formation fluid must be circulated through the drilling system and through the modular sub 200. To effect fluid flow through the sub 200, the sub body 201 has a plurality of fluid passageways 400*a–d* to allow drilling fluid to pass through the length of the sub 200 during drilling. The shape and number of individual passageways may be selected as desired to provide adequate flow through the sub 200. The shape and/or number of passageways may vary according to the number of component receptacles necessary for a particular modular sub.

Figure 5:
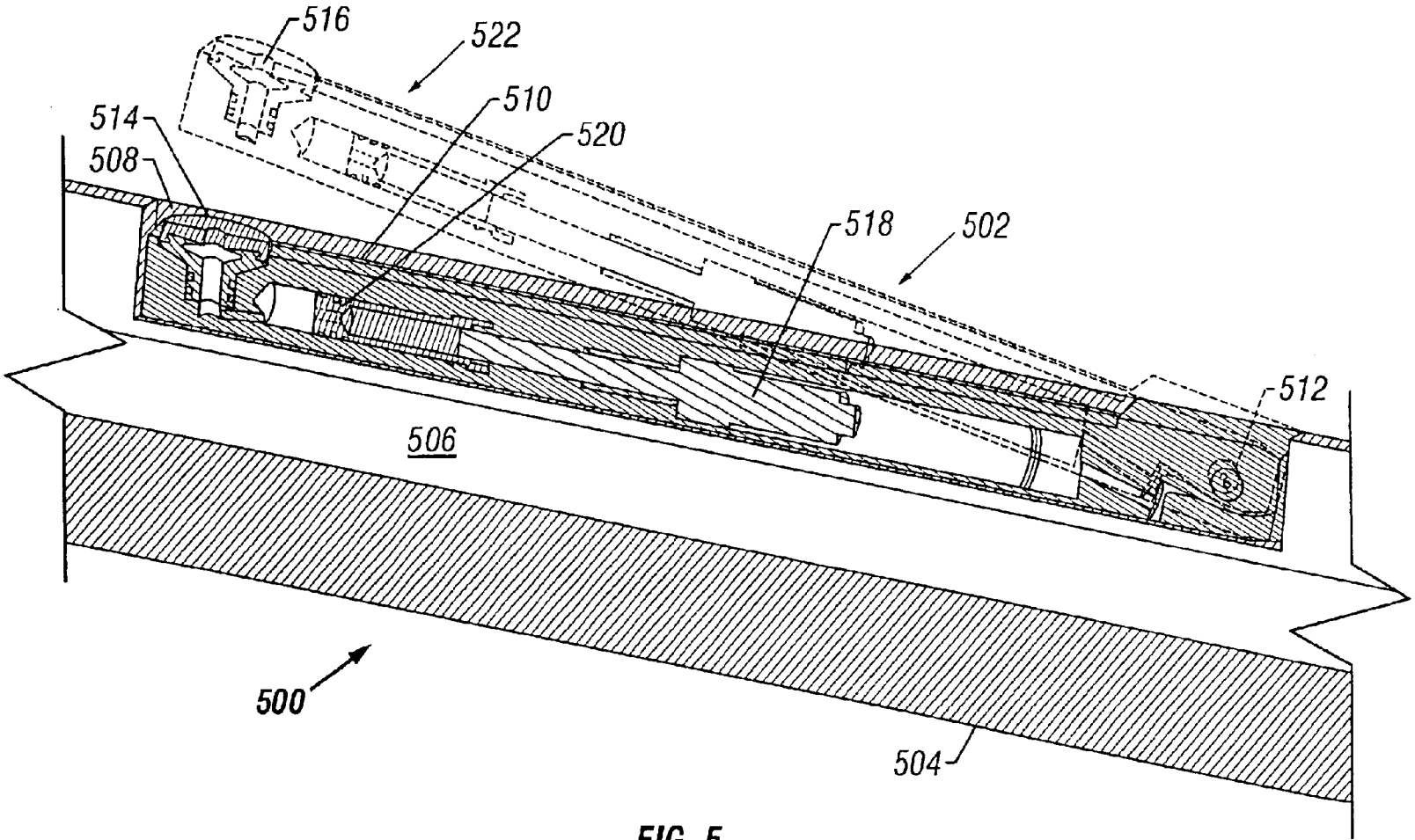
FIG. 5 shows an embodiment of the present invention wherein a modular sub includes a modular extendable rib assembly.

A modular rib capable of receiving formation fluid is provided in another embodiment of the present invention. FIG. 5 shows an embodiment of the present invention wherein a modular sub 500 includes an extendable rib module 502. The sub shown includes a sub body 504 having a central passageway 506 for allowing drilling fluid to flow through the sub body 504 during drilling operations. The sub body 504 has formed therein a recess 508 adapted for receiving the rib module 502.

The rib module 502 includes an elongated body 510 coupled to the sub body 504 at one end using a coupling 512 that preferably allows the rib module 502 to pivot at the coupling 512. The coupling 512 is preferably a pin-type coupling to allow release of the rib module when desired for repair or replacement. The rib module 502 is retractable into the recess 508 during drilling or otherwise when the sub 500 is moving within the borehole or is being transported. The rib module of the present invention provides either of two distinct functions; geosteering and formation testing. Extension and retraction of it's the rib module is controlled according to known methods such as a processor and position sensors. Extending the body 510 applies a force to the borehole wall, and the applied force is used to steer the sub along a desired drilling path.

The second function, formation testing, need not be integrated to the steering function described above. To provide the formation testing function, the rib module 502 includes a pad member 514 disposed at a second end of the rib body 510. The pad 514 provides sealing engagement with the borehole wall when the rib is in an extended position as shown by dashed lines 522. The pad 514 includes a port 516 for receiving fluid. A pump 518 disposed in the rib module 502 is used to urge fluid into the port 516, and may also be used to expel fluid outwardly from the port 516. In a preferred embodiment the rib module 510 includes a power supply (not separately shown) such as a battery for operating the pump. In a preferred embodiment, the rib module 502 includes one or more sensors 520 and a processor (not separately shown) for testing the fluid entering the port. The processor is used to accept a sensor output and to process the output for determining a parameter of interest of the formation and/or the formation fluid. The sensed characteristic and parameter of interest are substantially identical to those described above with respect to the test module described above and shown in FIG. 2.

In another embodiment, the coupling 512 is adapted to include hydraulic and/or electrical connectors. An electrical connector at the coupling 512 allows for wiring to transfer electrical power and data to and from the rib module 502. This electrical power and data can include control signals for controlling the modules in the rib or the rib module itself for steering the drill string. A hydraulic connector at the coupling 512 allows for hydraulic communication and control of the pump 518 and/or other components in the rib module 502.

Figure 6:
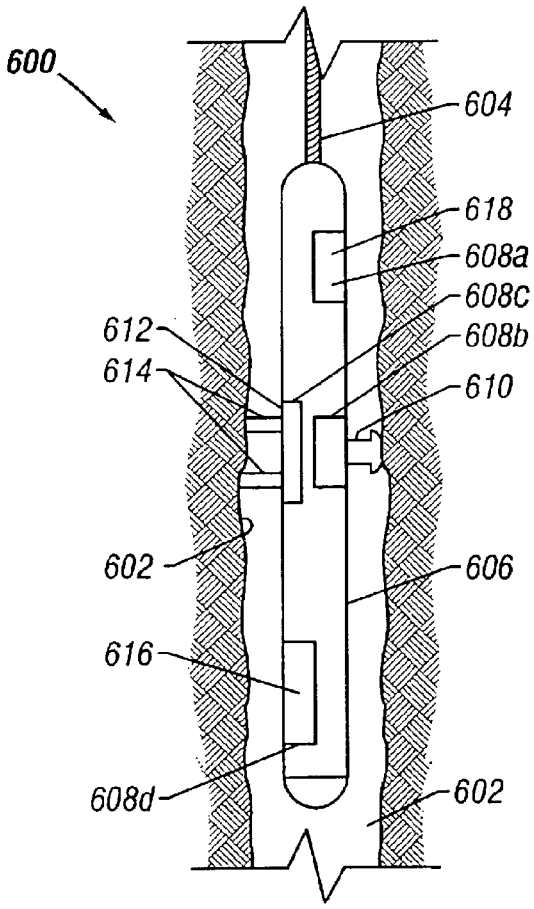
FIG. 6 is a modular wireline tool according to another embodiment of the present invention.

FIG. 6 is a modular wireline tool according to another embodiment of the present invention. The shows a wireline tool 600 suspended in a well borehole 602 by a cable 604 according to conventional practice. The tool includes a body 606 having a plurality of receptacles 608*a–d* for receiving modular testing components. In the embodiment shown an extendable probe module 610 is coupled to the body 606 in a corresponding receptacle 608*b*. The probe module 610 is substantially identical to the probe module 204 described above and shown in FIG. 2, the details of which do not require repeating here. A backup shoe module 612 is coupled to the body in a corresponding receptacle 608*c* positioned substantially diametrically opposed to the probe module 610. The backup shoe module 612 includes one or more extendable grippers 614 that engage the borehole wall for providing a counteracting force to keep the tool 600 centered in the borehole when the probe 610 is extended.

A controller module 618 is coupled to the body 606 in a corresponding controller module receptacle 608*a*. The controller module includes a processor (not separately shown) for controlling downhole components housed in the body 606. A sample/test module 616 is coupled to the in the body 606 in a corresponding sample/test module receptacle 608*d*. The sample test module 616 is operatively associated with the controller module 610 and the probe module 610 to perform wireline testing and sampling according to conventional practices. The sample test module 616 is fluidically coupled to the probe module 610 such that fluid received through the probe is conveyed to the sample test module for testing and/or storage. The sample/test module 616 is substantially identical to the sample/test module described above and shown in FIG. 2, thus is not described in detail here.

Once fluid is received at the probe module and conveyed to the sample/test module, sensors such as those described above and shown in FIG. 2 are used to sense a characteristic of the fluid. The sensor provides an output to the processor, and the processor processes the received output to determine one or more parameters of interest of the formation and/or the formation fluid. The parameter of interest may, of course, be any combination of parameters described above.

The invention described above in various embodiments shown in FIGS. 1–6 is a modular sub configured for receiving a specified compliment of modular components. The sub is fitted with connectors, wiring and tubing necessary for operation with the corresponding components. For example, a FTWD sub may include a probe module, a test/sampling module, and a controller module. The sub body includes pre-routed wiring and tubing that allows fluid communication between the probe module and the test/sampling module and data communication between the controller and the test/sampling module. The controller may be coupled to the probe module when using an extendable probe controlled by the controller.

Each component module and associated receptacle are preferably fitted with corresponding plug coupling devices to enable quick mating and demating of the component module to the sub. As used herein, the term plug coupling means a coupling that is adapted to mate fluid and/or electrical connections within the sub and component module without the use of tools. The term does not exclude, however, the possibility of using a fastener to mechanically secure the component module within the sub.

The foregoing description is directed to particular embodiments of the present invention for the purpose of illustration and explanation. It will be apparent, however, to one skilled in the art that many modifications and changes to the embodiment set forth above are possible without departing from the scope of the invention. It is intended that the following claims be interpreted to embrace all such modifications and changes.

What is claimed is:

1. An apparatus for use in a well borehole drilled into a formation, apparatus comprising:

a work string disposed in the borehole, the work string including at least one modular body portion, the at least one modular body portion having at least one receptacle; and a modular tool disposed in the at least one receptacle for carrying out a drilling operation, wherein the modular tool comprises a formation testing device detachably coupled in the at least one receptacle, wherein the formation testing device comprises an extendable probe having:

(a) a port for receiving formation fluid; and (b) a flexible barrier disposed in the probe for separating the port from a hydraulic fluid contained in a reservoir in the probe module, wherein a pump disposed on the work string operates to vary the amount of hydraulic fluid in the reservoir, the varying amount causing the flexible barrier to flex, the flexing barrier thereby urging formation fluid into the port.

2. The apparatus of claim 1, wherein the work string is selected from a group consisting of i) a drill pipe, ii) a coiled tube and iii) a wireline.

3. The apparatus of claim 1, wherein the formation test device further comprises a test module detachably coupled in a second receptacle and operably coupled to the probe module for testing formation fluid sampled by the probe module.

4. The apparatus of claim 1, wherein the modular tool body comprises one or more axial fluid passages to allow fluid to flow through the apparatus.

5. The apparatus of claim 1, wherein the modular tool comprises a drilling control device for geosteering during drilling operations.

6. The apparatus of claim 5, wherein the drilling control device comprises an extendable rib detachably coupled to the tool body in the at least one receptacle.

7. The apparatus of claim 6, wherein the extendable rib comprises a rib body having at least one second receptacle for receiving a second modular tool.

8. The apparatus of claim 7, wherein the second modular tool comprises a formation testing device detachably coupled in the at least one second receptacle.

9. The apparatus of claim 1, wherein the formation testing device includes at least one sensor for sensing a formation characteristic selected from the group consisting of i) pressure; ii) flow rate; iii) resistivity; iv) dielectric; v) temperature and vi) optical properties.

10. The apparatus of claim 1, wherein the formation testing device includes at least one sensor for sensing a drilling parameter selected from the group consisting of i) tool azimuth; ii) tool inclination; iii) drill bit rotation; and iv) weight on bit.

11. An apparatus for use in a well borehole drilled into a formation, the apparatus comprising:

a work string disposed in the borehole, the work string including at least one modular body portion, the at least one modular body portion having at least one receptacle; and a modular tool disposed in the at least one receptacle for carrying out a drilling operation, wherein the modular tool comprises a drilling control device for geosteering during drilling operations, wherein the drilling control device comprises an extendable rib detachably coupled to the tool body in the at least one receptacle, wherein the extendable rib comprises a rib body having at least one second receptacle for receiving a second modular tool, wherein the second modular tool comprises a formation testing device detachably coupled in the at least one second receptacle, wherein the formation testing device further comprises a probe module coupled in a first rib receptacle, the probe module having a pad member having a port therein for receiving formation fluid when the steering rib is extended.

12. The apparatus of claim 11, wherein the formation test device further comprises a test module detachably coupled in a second rib receptacle and operably coupled to the probe module for testing formation fluid sampled by the probe module.

13. The apparatus of claim 11, wherein the probe module further comprises a flexible barrier disposed in the probe for separating the port from hydraulic fluid contained in a reservoir in the probe module, wherein a pump module operates to vary the amount of hydraulic fluid in the reservoir, the varying amount causing the flexible barrier to flex, the flexing barrier thereby urging formation fluid into the port.

14. A method of conducting a drilling operation in a well borehole comprising:

(a) coupling one or more modular tools to a work string having at least one receptacle therein for detachably receiving the one or more modular tools;

(b) conveying the work string into the borehole; and (c) carrying out the drilling operation using the one or more modular tools, wherein the one or more modular tools comprise an extendable rib and the drilling operation comprises controlling drilling direction using the extendable rib, wherein the extendable rib comprises at least one second receptacle for receiving a second modular tool, the method further comprising using a formation testing device detachably counted in the at least one second receptacle for testing a formation traversed by the borehole during drilling, wherein the formation testing device comprises a probe module having a pad member with a port therein for receiving formation fluid when the steering rib is extended, the method further comprising using the rib in an extended position during drilling to extract a fluid sample from an adjacent formation.

15. The method of claim 14, wherein sampling the fluid further comprises selectively extending the extendable probe member and urging the fluid into a port in the extendable probe member using a pump module detachably coupled in a work string second receptacle.

16. The method of claim 14, wherein the one or more modular tools further comprise a test module coupled to the work string in a second receptacle and operably coupled to the probe module, and wherein the drilling operation further comprises testing the sampled fluid using the test module.

17. The method of claim 14, wherein the formation test device further comprises a test module detachably coupled in a second rib receptacle and operably coupled to the probe module, the method further comprising testing the sampled fluid using the test module.

18. A system for use in conducting a drilling operation, the system comprising:

(a) a work string conveyed in a well borehole;

(b) a sub coupled to the work string, the sub including at least one receptacle therein;

(c) a modular tool detachably coupled to the sub in the at least one receptacle for conducting the drilling operation; and (d) a controller for controlling the drilling tool, wherein the modular tool comprises a probe module detachably coupled in a first receptacle, the probe module having an extendable probe member adapted for extracting fluid from a formation adjacent the probe module, wherein the extendable probe comprises:

(a) a port for receiving formation fluid; and (b) flexible barrier disposed in the probe for separating the port from hydraulic fluid contained in a reservoir in the probe module, wherein the pump module operates to vary the amount of hydraulic fluid in the reservoir, the varying amount causing the flexible barrier to flex, the flexing barrier thereby urging formation fluid into the port.

19. The system of claim 18, wherein the work string is selected from a group consisting of i) a drill pipe, ii) a coiled tube and iii) a wireline.

20. The system of claim 18, further comprising a test module detachably coupled in a second receptacle and operably coupled to the probe module for testing fluid sampled by the probe module.

21. The system of claim 18, wherein the sub further comprises one or more axial fluid passages to allow fluid to flow through the sub.

22. The system of claim 18, wherein the modular tool comprises an extendable rib detachably coupled to the sub in the at least one receptacle for controlling drilling direction.

23. A system for use in conducting a drilling operation, the system comprising:

(a) a work string conveyed in a well borehole;

(b) a sub coupled to the work string, the sub including at least one receptacle therein;

(c) a modular tool detachably coupled to the sub in the at least one receptacle for conducting the drilling operation; and (d) a controller for controlling the drilling tool, wherein the modular tool comprises an extendable rib detachably coupled to the sub in the at least one receptacle for controlling drilling direction, wherein the extendable rib comprises a probe module coupled in a first rib receptacle, the probe module having a pad member with a port therein for receiving formation fluid when the rib is extended.

24. The system of claim 23, wherein the extendable rib further comprises a test module detachably coupled in a second rib receptacle and operably coupled to the probe module for testing fluid sampled by the probe module.

25. The system of claim 23, wherein the probe module further comprises a flexible barrier disposed in the probe for separating the port from hydraulic fluid contained in a reservoir in the probe module, wherein a pump module operates to vary the amount of hydraulic fluid in the reservoir, the varying amount causing the flexible barrier to flex, the flexing barrier thereby urging formation fluid into the port.

* * * * *